US008245484B2

(12) United States Patent
Yamamoto et al.

(10) Patent No.: US 8,245,484 B2
(45) Date of Patent: Aug. 21, 2012

(54) BAG OPENING METHOD AND APPARATUS FOR USE IN BAG FILLING AND PACKAGING

(75) Inventors: Kazunori Yamamoto, Iwakuni (JP); Masanori Yasuhira, Iwakuni (JP)

(73) Assignee: Toyo Jidoki Co., Ltd, Tokyo (JP)

( * ) Notice: Subject to any disclaimer, the term of this patent is extended or adjusted under 35 U.S.C. 154(b) by 467 days.

(21) Appl. No.: 12/657,319

(22) Filed: Jan. 19, 2010

(65) Prior Publication Data

US 2010/0180550 A1 Jul. 22, 2010

(30) Foreign Application Priority Data

Jan. 20, 2009 (JP) ..... 2009-009777

(51) Int. Cl.
*B65B 57/02* (2006.01)

(52) U.S. Cl. ..... 53/75; 53/459; 53/468; 53/64; 53/70

(58) Field of Classification Search ..... 53/457, 53/492, 459, 468, 52, 381.1, 381.6, 64, 67, 53/70, 75

See application file for complete search history.

(56) References Cited

U.S. PATENT DOCUMENTS 4,283,901 A * 8/1981 Schieser et al. ..... 53/75
4,306,399 A * 12/1981 Tsujimoto et al. ..... 53/52
5,052,168 A * 10/1991 DeWitt et al. ..... 53/492
5,140,801 A * 8/1992 Wild ..... 53/459
6,775,960 B2 * 8/2004 Hansen ..... 53/492
7,021,036 B2 * 4/2006 Hiramoto et al. ..... 53/562
2009/0158694 A1 * 6/2009 Matheyka ..... 53/468

* cited by examiner

*Primary Examiner* — Christopher Harmon
(74) *Attorney, Agent, or Firm* — Daniel P. Burke & Associates, PLLC

(57) ABSTRACT

A bag opening method and apparatus for use in bag filling and packaging in which a bag B is gripped at its laterally opposite side edges with a pair of gripping members and moved along a predetermined path. A pair of suction cups 23 disposed facing each other at respective mutually spaced standby positions are moved to respective closest positions at which a vacuum is applied to the suction cups to cause them to adhere to the outer surfaces of the opposite side walls of the bag. The suction cups are retracted away from each other to respective intermediate positions between the closest and standby positions. The suction cups having reached the intermediate positions are stopped there for a predetermined period of time. Thereafter, the suction cups are retracted from the intermediate positions to the standby positions, respectively. The vacuum acting upon the suction cups is measured at some point during a time period which starts immediately before the suction cups reach the intermediate positions and ends at the termination of the period of time during which the suction cups are stopped at the intermediate positions. The application of the vacuum to the suction cups is stopped at a time between a time after the measurement of the vacuum and a time immediately after the starting of movement of the suction cups to the standby positions. The measured vacuum is compared to a preset reference value to judge whether or not the bag has been opened satisfactorily. The positions of the intermediate positions are changed according to the width of the bag.

12 Claims, 9 Drawing Sheets

BAG OPENING METHOD AND APPARATUS FOR USE IN BAG FILLING AND PACKAGING

BACKGROUND OF THE INVENTION

1. Technical Field

The present invention relates to a bag opening method and apparatus used to open bags in bag filling and packaging. More particularly, the present invention relates to a bag opening method and apparatus for use in bag filling and packaging in which a bag is gripped at its laterally opposite side edges with a pair of grippers (left and right grippers) and moved along a predetermined path to undergo predetermined packaging processes successively. Even more particularly, the present invention relates to a bag opening method and apparatus that are applicable to a plurality of different kinds of bags having different widths and that are capable of surely detecting whether or not each bag has been opened satisfactorily.

2. Background Art

Bag filling and packaging machines include those of the type in which a bag is gripped at its laterally opposite side edges with a pair of grippers (left and right grippers) and moved along a predetermined path to undergo predetermined packaging processes successively. In this type of packaging machine, each bag is supplied in a state where its mouth is closed, and the bag mouth is opened by a bag opening apparatus of the packaging machine. In the case of handling so-called self-supporting bags, the packaging machine uses a bag opening apparatus that opens the mouth of each bag and that unfolds and expands the bottom portion of the bag as well.

In a bag filling and packaging machine, if a bag fails to open satisfactorily, the subsequent operations such as the filling step cannot be accurately performed, resulting in a defective. In order to prevent such a problem, it is necessary to determine whether or not the bag has been opened satisfactorily prior to the operations such as the filling step. Japanese Patent Application Publication No. Hei 08-40420, for example, discloses a bag opening method which determines whether or not a bag has been opened satisfactorily.

According to the method disclosed in the above-described JP Publication, a pair of suction cups positioned at their standby positions the spacing between which is a specified spacing S are first advanced toward each other. When they reach their respective closest positions, the suction cups abut against the respective outer surfaces of the opposite side walls of a bag that is closed, and are stopped. Then a vacuum is applied to the suction cups through a vacuum line from a vacuum source to cause the suctions cups adhere to the bag. After the suction cups have been stopped at the closest positions for a predetermined time period, the suction cups are retracted away from each other by a first opening operation so that the spacing between the suction cups reaches a spacing S1 (intermediate position) shorter than the specified spacing S (standby position), and when the suction cups reach the respective intermediate positions a synchronizing signal is issued to measure the vacuum acting upon the suction cups at that time. After the suction cups have been stopped for a predetermined time period at the intermediate position or following the first opening operation, a second opening operation is performed to retract the suction cups away from each other to their respective standby positions where the spacing between the suction cups reaches the specified spacing S. Here the followings are defined;

t1: the time during which the first opening operation is performed, namely the time it takes for the suction cups to move from their respective closest positions to their respective intermediate positions, t0: the time during which the suctions cups adhering to the bag stop at their closest positions, and t: the time it takes for the vacuum in the vacuum pipeline to stabilize after start of application of vacuum to the suctions cups.

According to this method, the time t1 is set substantially the same as the time t. Thus, the sum of the time t1 and the time t0 is made longer than the time t to allow the vacuum in the vacuum pipeline to have surely stabilized when the synchronizing signal is issued. It should be noted that the vacuum is released to detach the suction cups from the bag immediately before the spacing between the suction cups reaches the specified spacing S, i.e. in synchronism with the time when the degree of opening of the bag reaches a maximum.

In the above-described Japanese Patent Application Publication No. Hei 08-40420, the bag opening method is disclosed as a technique to be applied to suction cups used to adhere to the side walls at portions near the bottom of what is called a self-supporting bag. This technique is capable of accurately determining whether or not each bag has been opened satisfactorily with regard to bags having a particular width by setting the spacings S and S1 according to the width of the bags and further setting the retracting speed of the suction cups according to the spacings S and S1.

Providing different packaging machines for different kinds of bags having different widths costs a great deal in terms of plant and equipment investment. It is therefore general practice to perform bag filling on a plurality of different kinds of bags having different widths using the same bag filling and packaging machine. In this case, generally, the spacing S1 (intermediate position) is set constant in conformity with the width of bags having the smallest width of all bags to be used, and the specified spacing S (standby position) is set constant in conformity with the width of bags having the largest width of all bags to be used. The timing of when the suction cups to adhere to a bag and when they release the suction cups from the bag, i.e. the vacuum application and release timings, are also typically set constant from the viewpoint of operation efficiency.

FIG. 7 illustrates operations of the prior art. In this case, the adhesion and detachment of the suction cups to and from the bag and the movement and stopping of the suction cups are as shown in the time chart of FIG. 4. In FIG. 4, the term "standby position" refers to where the suction cups are at respective positions at which the spacing therebetween is S, i.e. the specified spacing S as stated in Japanese Patent Application Publication No. Hei 08-40420 . The term "intermediate position" refers to where the suction cups are at respective positions at which the spacing therebetween is S1, which is less than the specified spacing S. The term "closest position" refers to where the suction cups are at respective positions at which the suction cups abut against the respective outer surfaces of the opposite side walls of a closed bag. The vacuum detection with the sensor is performed during the period of time that the suction cups are at the intermediate positions.

In the case of bags having a narrow width, the spacing S1 is set in conformity with bags having the smallest width, as stated above. Therefore, when the suction cups move from the first separating position (intermediate position) where the spacing is S1 toward the second separating position (standby position) where the spacing is S, the bag is forcibly separated from the suction cups adhering thereto (at point a in FIG. 7, for example). It has been found that a side wall of a bag will sometimes move toward the other side in reaction to this forced separation, resulting in the bag mouth not remaining open as much as desired (see FIG. 8). Accordingly, although the apparatus had judged that the bag had been opened satisfactorily on the basis of the vacuum detected just before the suction cups separated from the bag, the bag actually may have reclosed i.e. resulting in an operation which failed to open the bag satisfactorily or may have partially closed after detachment of the suction cups. In the case of bags having a wide width, the application of the vacuum to the suction cups is typically stopped shortly before the spacing reaches S (at point b in FIG. 7, for example). Thus, the bag opening operation is stopped at that time, and the suction cups separate from the bag and retract to their respective positions where the spacing therebetween is S (specified spacing). However, if the vacuum leaks before the cups reach the vacuum application stop position, e.g. due to deterioration of either suction cup or dislocation of the adhering position of the cup, then the suction cup also detaches from the bag undesirably, and one side wall of the bag moves toward the other side (see FIG. 9). In this case also, although the apparatus had judged that the bag had been opened satisfactorily, the bag actually has failed to open satisfactorily.

Japanese Patent Application Publication No. Hei 06-156437 discloses a technique wherein a pair of suction members 10 and 11 is initially positioned spaced from the bag side walls. The spacing is determined according to the width of bags to be used to dispose the suction members with a predetermined spacing therebetween in advance, and when a bag is placed between the suction members, the suction members are caused to suck the opposite side walls of the bag with a suction force generated by a suction pump, thereby opening the bag mouth. This bag opening method is totally different in basic principle from the bag opening method of Japanese Patent Application Publication No. Hei 08-40420, in which the suction cups are first caused to adhere to the respective outer surfaces of the opposite side walls of a closed bag, and subsequently the suction cups are retracted away from each other to open the bag. With the bag opening method of Japanese Patent Application Publication No. Hei 06-156437, the suction members are separate from the bag when the suction of the bag is started. Therefore, it is necessary to apply a very strong suction force in order to open the bag mouth with the suction members set separate from the bag. In addition, bags are usually made of a synthetic resin and hence the opposite side walls of the bag mouth are difficult to separate from each other due to the action of static electricity in addition to the fact that the bag mouth is merely physically closed. Accordingly, if the balance of vacuums acting on the two suction members, respectively, is destroyed, even slightly, the bag is undesirably drawn by suction to either of the suction members without being opened. Japanese Patent Application Publication No. Hei 06-156437 does not disclose any means for detecting such a failure in opening bags.

SUMMARY OF THE INVENTION

An object of the present invention is to provide a bag opening method and apparatus capable of opening bags surely and stably regardless of the bag size (width) and capable of accurately judging whether or not each bag has been opened satisfactorily.

The present invention provides a bag opening method for use in bag filling and packaging in which a bag is gripped at its laterally opposite side edges with a pair of gripping members and moved along a predetermined path to open the bag and to fill an article to be packaged into the bag. One method of the present invention comprises the following steps: the step of moving a pair of suction cups which are facing each other from respective mutually spaced standby positions to respective closest positions at which the suction cups are closest to each other; the step of applying a vacuum to said suction cups to adhere to the outer surfaces of the opposite side walls of the bag at the closest positions; the step of retracting the suction cups away from each other to respective intermediate positions between the closest positions and the standby positions while moving the gripping members toward each other in synchronism with the movement of the suction cups to the intermediate positions; the step of keeping the suction cups stopped at the intermediate positions for a predetermined period of time; the step of measuring the vacuum acting upon the suction cups at some point during a time period which starts immediately before the suction cups reach the intermediate positions and ends at a termination of the period of time during which the suction cups are stopped at the intermediate positions; the step of retracting the suction cups from the intermediate positions to the standby positions, respectively; the step of stopping the application of vacuum to the suction cups at a time between a time after the measurement of vacuum and a time immediately after the starting of movement of the suction cups to the standby positions; the step of comparing the measured vacuum to a preset reference value to judge whether or not the bag has been opened satisfactorily; and the step of changing the positions of the intermediate positions according to the width of the bag.

The bag opening method may further include the step of detecting the width of the bag. In this case, the step of changing the positions of the intermediate positions is carried out on the basis of the detected width.

Further, the speed of movement of the suction cups from the closest positions to the intermediate positions, the dwell time of the suction cups at the intermediate positions, and the speed of movement of the suction cups from the intermediate positions to the standby positions may be constant regardless of the positions of the intermediate positions.

In addition, the present invention provides a bag opening apparatus for use in a bag filling and packaging machine in which a bag is gripped at its laterally opposite side edges with a pair of gripping members and moved along a predetermined path to open the bag and to fill an article to be packaged into the bag. The apparatus includes the following constituent elements: a pair of suction cups disposed facing each other and connected to a vacuum source through a switching valve; a servomotor that move the suction cups between respective mutually spaced standby positions, respective closest positions at which the suction cups are closest to each other, and respective intermediate positions between the standby positions and the closest positions; a pressure sensor that detects a vacuum acting upon the suction cups; and a controller having a first control unit that controls the application of a vacuum to the suction cups, a second control unit that controls the servomotor to control the movement and stop of the suction cups, a third control unit that controls the timing of vacuum detection by the pressure sensor, a judging unit that compares the detected vacuum to a preset reference value to judge whether or not the bag has been opened satisfactorily, and a fourth control unit that changes the positions of the intermediate positions according to the width of the bag to be filled.

The apparatus may be arranged to function as follows. The second control unit moves the suction cups from the standby positions to the closest positions, stops the suction cups at the closest positions for a predetermined period of time, moves the suction cups to the intermediate positions, stops the suction cups at the intermediate positions for a predetermined period of time, moves the suction cups to the standby positions, and stops the suction cups at the standby positions for a predetermined period of time. The third control unit causes the pressure sensor to measure the vacuum acting upon the suction cups at some point during a time period which starts immediately before the suction cups reach the intermediate positions and ends at the termination of the period of time during which the suction cups are at the intermediate positions. The first control unit starts the application of a vacuum to the suction cups at a time during a time period which starts immediately before the suction cups reach the closest positions and ends at the termination of the period of time during which the suction cups stop at the closest positions and releases the applied vacuum at a time between a time after the measurement of vacuum and a time immediately after the starting of movement of the suction cups to the standby positions.

The bag opening apparatus may further include a bag width detecting unit that detects the width of the bag. In this case, the fourth control unit changes the positions of the intermediate positions on the basis of a signal from the bag width detecting unit.

The second control unit may maintain constant the speed of movement of the suction cups from the closest positions to the intermediate positions, the dwell time of the suction cups at the intermediate positions, and the speed of movement of the suction cups from the intermediate positions to the standby positions regardless of the change of the positions of the intermediate positions made by the fourth control unit.

According to the present invention, the bag opening completion timing at which the suction cups separate from the outer surfaces of the opposite side walls of the bag is preferably made substantially coincident with the timing of releasing the adhesion of the suction cups to the bag regardless of the width of bags to be used. Therefore, the suction cups smoothly separate from the outer surfaces of the opposite side walls of the bag without the possibility that the suction cups adhering to the bag may be forcibly separated from the bag. Accordingly, it is possible to prevent a bag opening failure caused by one side wall of the bag moving toward the other side in reaction to the forced separation, causing the bag mouth to be closed undesirably, and also possible to prevent the judging unit from mistakenly judging the failed bag to have been opened satisfactorily.

In addition, the detection whether or not the bag has been opened satisfactorily is performed immediately before the completion of the bag opening operation regardless of the bag width. Therefore, if one side wall of the bag detaches from the suction cup for some reason in the course of opening the bag and moves toward the other side in reaction to the detaching motion, causing the bag mouth to be closed undesirably, the bag can surely be detected as having failed to open satisfactorily.

One aspect of the present invention is the adjustment of the intermediate position of the suction cups. Another aspect of the present invention is stopping of the vacuum acting upon the suction cups at some point during a time period which starts after the measurement of vacuum and ends immediately after the starting of movement of the suction cups from the intermediate position to the standby position.

DETAILED DESCRIPTION OF THE PREFERRED EMBODIMENTS

Embodiments of the present invention will be explained below with reference to the accompanying drawings. It should be noted that the following embodiments are for illustrative purposes only, and that the scope of the present invention is not limited to these embodiments.

Figure 1:
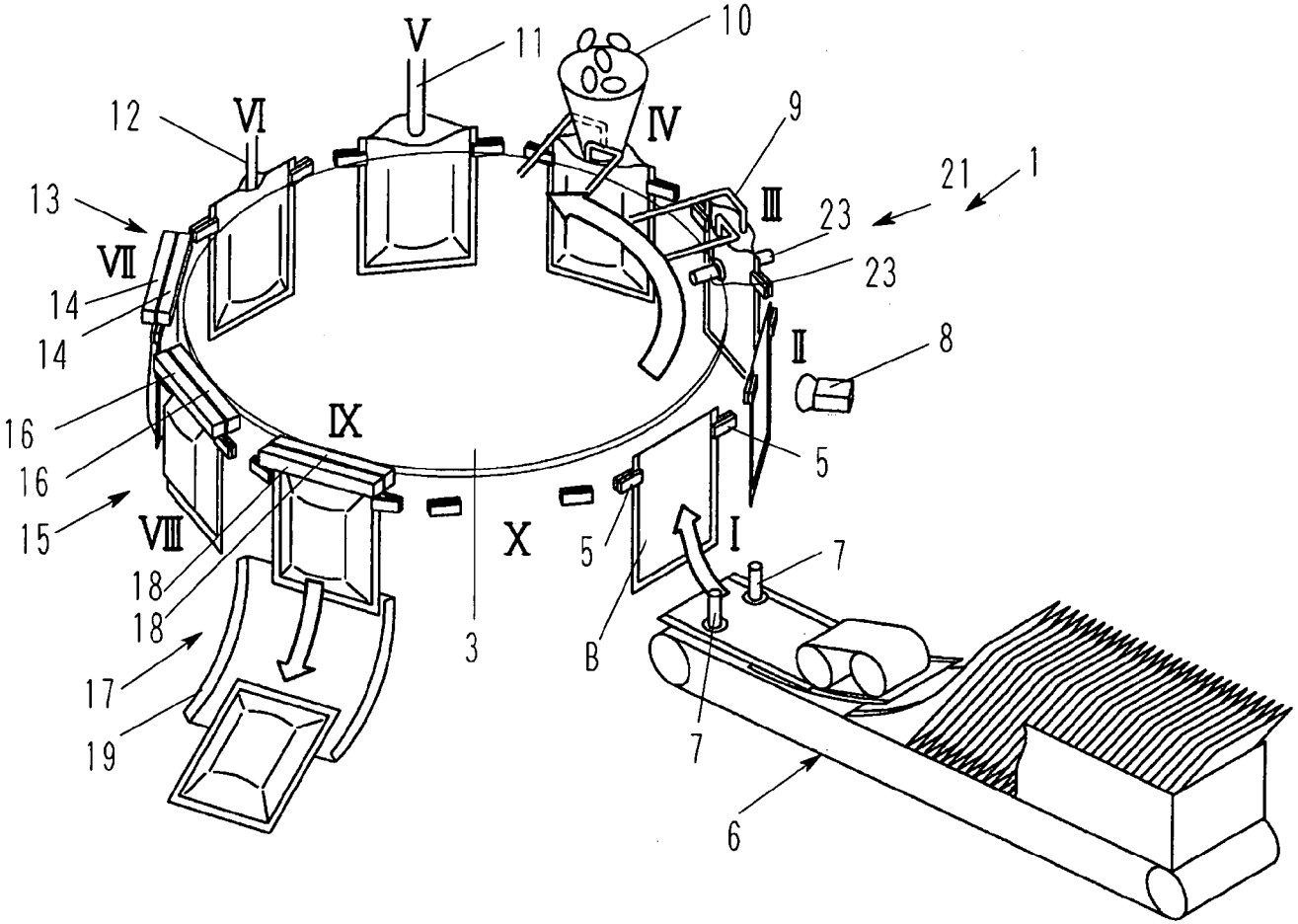
FIG. 1 is a perspective view showing the overall structure of a bag filling and packaging machine using a bag opening apparatus according to an embodiment of the present invention.

FIG. 1 is a perspective view showing the overall structure of a bag filling and packaging machine (hereinafter referred to as "packaging machine") 1 using a bag opening apparatus according to an embodiment of the present invention. In this embodiment, the packaging machine 1 is of a rotary type having a rotary table 3 that rotates in the direction of the arrow shown in the figure. The rotary table 3 is provided with pairs of grippers 5 at predetermined spaces in the circumferential direction. Each pair of grippers 5 hold a bag B by gripping the laterally opposite side edges thereof. Thus, as the rotary table 3 rotates intermittently, the bag B moves successively through various stations, i.e. stop positions I to X. At the stations I to X, various processing steps are executed while the rotary table 3 is at rest.

The first station I performs the step of feeding bags B. The bags B are delivered one by one by a bag magazine 6, which is a conveyor magazine in this embodiment. Each bag B thus delivered is taken out by a pair of bag take-out suction cups 7 and moved toward a pair of grippers 5. While being moved, the bag B is changed in posture to an upright position. The grippers 5 receive and hold the upright bag B. The structure of the conveyor magazine 6 and the arrangement for delivering the bag B from the conveyor magazine 6 to the grippers 5 by using the bag take-out suction cups 7 are publicly known. Therefore, a detailed description thereof is omitted herein. The subsequent station II performs the step of detecting the width of the bag B with a camera 8 and inputs the result of the detection to a controller 53 (described later). The station III performs the step of opening the mouth of the bag B with a bag opening apparatus 21 having a pair of mouth opening suction cups 23 so as to allow a mouth opening guide 9 to maintain the bag B in the state of having its mouth opened. The mouth opening guide 9, which is of the follow-up type, moves to the station IV, following the bag B, and returns to the station III at predetermined timing. The bag opening apparatus 21 will be explained later. The station IV performs the step of filling the bag B with a solid material to be packaged by using a hopper 10. The station V performs the step of filling the bag B with a liquid material to be packaged that is stored in a tank (not shown) through a nozzle 11.

The subsequent station VI performs the step of blowing steam into the bag B from a steam nozzle 12 to replace the air in the bag B with the steam to thereby deaerate the interior of the bag B. The station VII is provided with a primary sealing device 13 having a pair of hot plates 14. The station VIII is provided with a secondary sealing device 15 having a pair of hot plates 16 to seal the bag B secondarily. The station IX is provided with a cooling device 17 having a pair of cooling plates 18 to cool the heat-sealed portion of the bag B. After being cooled, the bag B finished as a product is discharged onto a product discharge chute 19. At the station X, a bag B judged to have failed to open satisfactorily is discharged onto a different chute (not shown).

Figure 2:
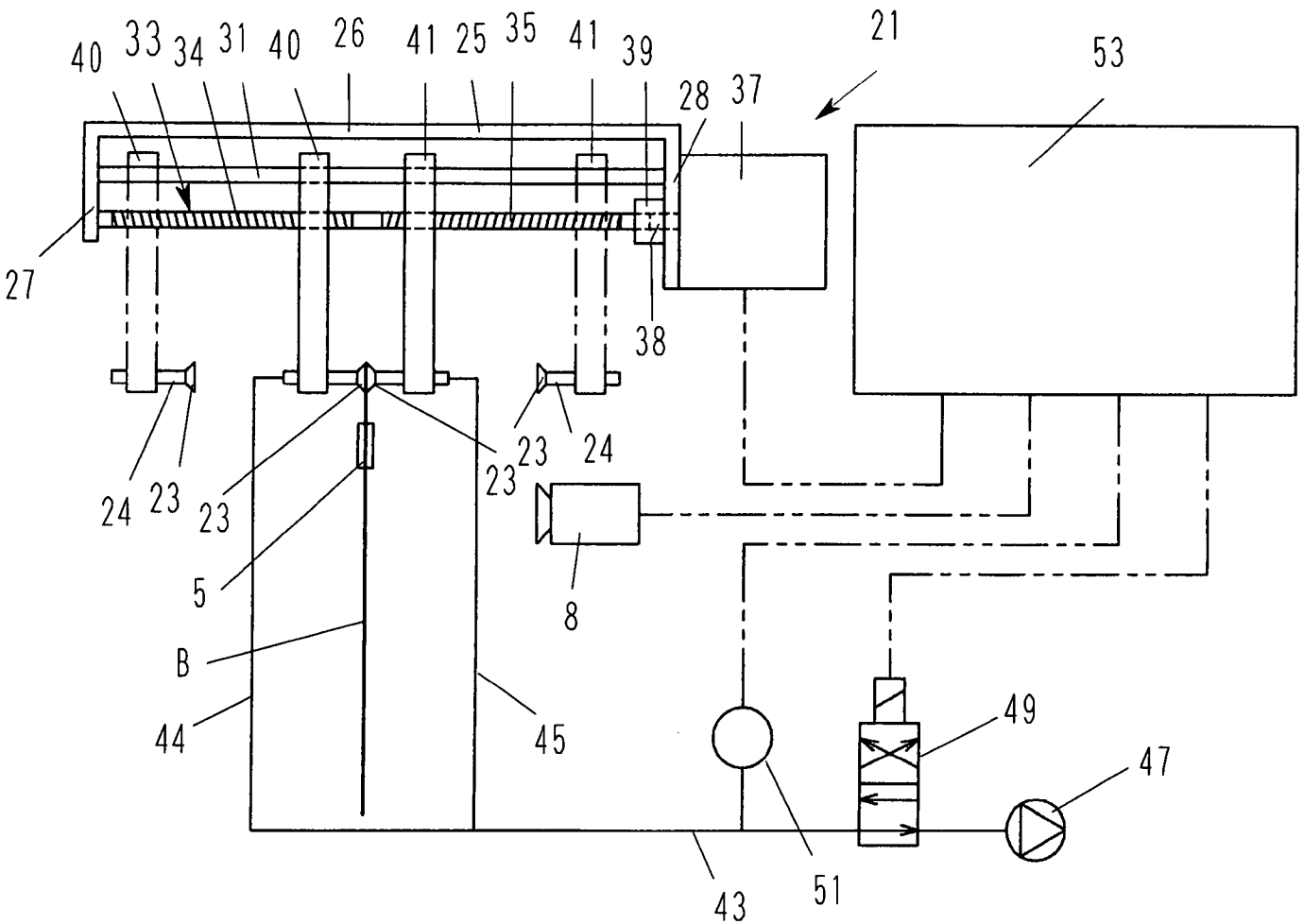
FIG. 2 is a block diagram of the bag opening apparatus.

Next, the structure of the bag opening apparatus 21 disposed at the station III will be explained with reference to the block diagram of FIG. 2. FIG. 2 shows a state where a bag B gripped at its laterally opposite side edges with a pair of grippers 5 has moved to and stopped at the station III. The pair of suction cups 23 are disposed facing each other across the bag B.

Reference numeral 25 denotes a frame of the bag opening apparatus 21 that is secured to supports or the like (not shown). The frame 25 has a horizontal portion 26 extending horizontally and arm portions 27 and 28 extending downward in parallel to each other from the opposite ends of the horizontal portion 26. A guide shaft 31 is secured at its opposite ends to the arm portions 27 and 28 to extend parallel to the horizontal portion 26. A screw shaft 33 extends below and parallel to the guide shaft 31. One end of the screw shaft 33 is rotatably attached directly to one arm portion 27 of the frame 25. The other end of the screw shaft 33 is rotatably attached through a coupling member 39 to an output shaft 38 of a servomotor 37 installed on the outside surface of the other arm portion 28. The screw shaft 33 is rotatable together with the output shaft 38 as one unit. The screw shaft 33 has a left-hand thread 34 and a right-hand thread 35 formed at the left and right sides, respectively, of its center (the left- and right-hand threads 34 and 35 may be formed at the right and left sides, respectively, of the screw shaft 33). Slide bars 40 and 41 are installed in thread engagement with the left- and right-hand threads 34 and 35, respectively. The slide bars 40 and 41 have holes formed in their respective upper end portions. The holes of the slide bars 40 and 41 are fitted with the guide shaft 31. Accordingly, the slide bars 40 and 41 move in mutually opposite directions along the guide shaft 31 and the screw shaft 33 in response to the rotation of the servomotor 37. That is, the slide bars 40 and 41 move toward or away from each other according to the direction of rotation of the servomotor 37.

The slide bars 40 and 41 have the above-described suction cups 23 attached to their lower ends through mounting shafts 24, respectively. The slide bars 40 and 41 shown by the two-dot chain lines in the figure are at their respective standby positions. In the standby positions, the suction cups 23 are positioned remotest from each other to wait for a bag B to come to the station III. When a bag B comes to the station III, the servomotor 37 is activated to move the slide bars 40 and 41 to the respective positions shown by the solid lines in the figure. When the suction cups 23 are closest to each other, they abut against the respective outer surfaces of the opposite side walls of the bag B at rest. The operation of the suction cups 23 will be detailed later.

Reference numeral 43 denotes piping connected at one end to a vacuum source 47 through a switching valve 49. The other end of the piping 43 is divided into two branch pipes 44 and 45, which are connected to the suction cups 23, 23, respectively. In response to the switching operation of the switching valve 49, a vacuum is applied to the suction cups 23 or an existing vacuum applied to the cups 23 is released. Reference numeral 51 denotes a pressure sensor attached to the piping 43. The pressure sensor 51 measures a vacuum acting upon the suction cups 23. The servomotor 37, the switching valve 49, the pressure sensor 51 and the camera 8 provided at the station II are connected to the controller 53.

Figure 3:
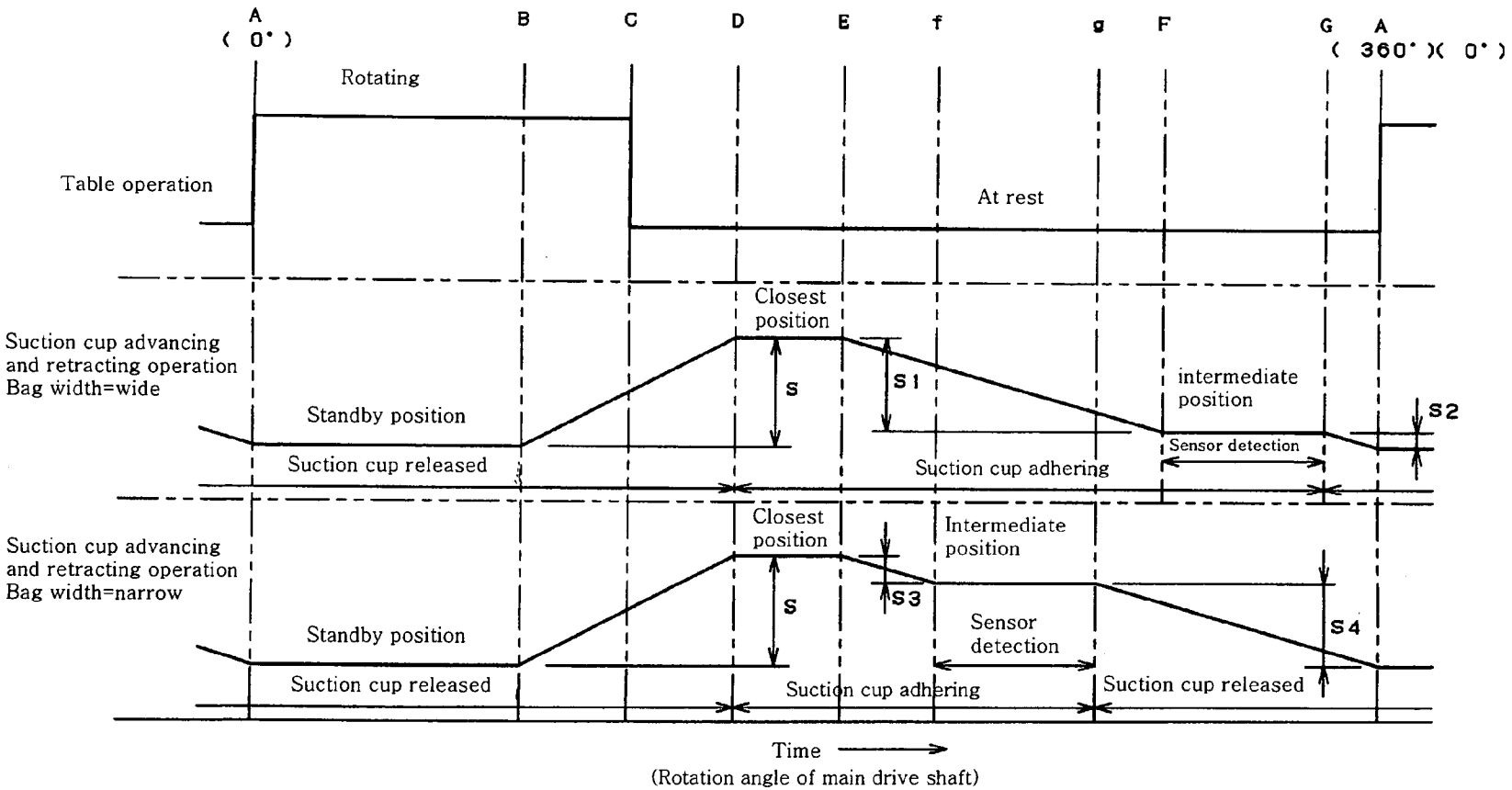
FIG. 3 is a time chart showing the operation of suction cups.

Next, the operation of the suction cups 23 will be explained with reference to the time chart shown in FIG. 3. The time chart used in this embodiment is based on the time it takes for a main drive shaft to rotate one revolution, 360 degrees. The packaging machine 1 of this embodiment is provided with a main drive shaft (not shown) and the main drive shaft is associated with the table 3 and other devices including the bag opening apparatus 21 equipped at the respective stations I to X such that while the main drive shaft rotates one revolution, bags at rest at the respective stations are moved to and stopped at the respective next stations and processing at the respective stations are executed. Therefore, the table 3 intermittently rotates one revolution while the main drive shaft rotates ten revolutions in this embodiment. As stated above, the time chart used in this embodiment is based on the time it takes for a main drive shaft to rotate one revolution. One revolution of the main drive shaft is defined as 1 cycle. It should be noted that the time chart is not based on absolute time. Namely, when the rotating speed of the main drive shaft changes, the total time of 1 cycle changes and the time that a bag is at each ten station changes, but the relative time and the relative angular position of a bag at which one of the bag opening steps occurs as the bag passes through station III does not change.

Prior to making a detailed description of the operation of the suction cups 23, let us explain the basic operation in terms of movement of the suction cups 23. That is, the bag opening apparatus 21 of this embodiment is capable of opening a plurality of different kinds of bags having different widths. The suction cups 23 are each movable between a standby position where the spacing between the suction cups 23 is widest, a closest position where the spacing between the suction cups 23 is narrowest, and an intermediate position between the standby and closest positions. The standby position is where each suction cup 23 is positioned when waiting for a bag B to come to the station III. The spacing S between the suction cups 23 at their respective standby positions is fixed and set to a size at which bags having the largest width of all bags to be filled can be opened. The closest position is where the suction cups 23 are closest each other. At this closest position, the suction cups 23 come in substantially close contact with each other with the bag B interposed therebetween. The suction cups 23 when at their respective closest positions are spaced from each other by an amount corresponding to the thickness of the bag B, which may be regarded as substantially zero as compared to the spacing S. The intermediate position is a position between the closest position and the standby position. The spacing between the suction cups 23 at their respective intermediate positions is variable according to the width of bags B to be filled. That is, the spacing between the suction cups 23 at their respective intermediate positions is adjusted on the basis of the width of bags B which is detected with the camera 8 provided at the station II and input to the controller 53. If the suction cups 23 have been normally adhering to the outer surfaces of the opposite side walls of the bag B, the bag opening operation for the bag B has already been substantially completed when the suction cups 23 reach their respective intermediate positions. Meanwhile, the vacuum acting upon the suction cups 23 is detected with the pressure sensor 51. Thereafter, the suction cups 23 are returned to their respective standby positions. During the returning movement, the bag mouth is opened slightly further, and the vacuum operation is stopped when the bag mouth has been opened by a predetermined target amount. Consequently, the suction cups 23 separate from the bag B after the bag mouth is fully opened and move to their respective standby positions. The bag B remains in the opened position. The grippers 5 gripping the laterally opposite side edges of the bag B move toward each other as the bag opening operation progresses to allow the bag B to be opened smoothly without encountering a resistance.

Figure 4:
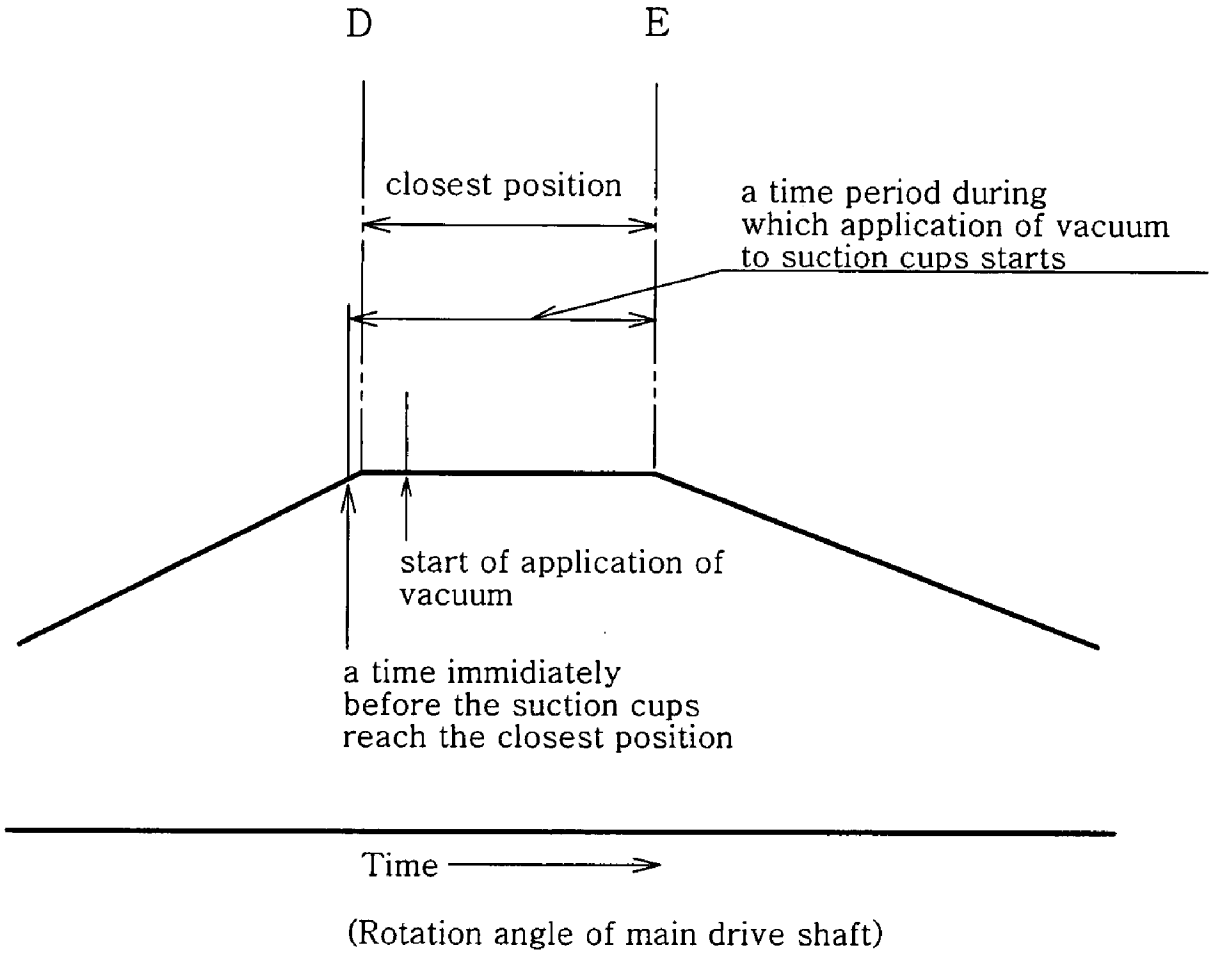
FIG. 4 is a time chart showing a time period during which application of vacuum to the suction cups starts.

First, the operation of the suction cups 23 when the width of bags B to be used is the largest will be explained with reference to FIG. 3. During the stop at the station II, the width of the bag B is detected with the camera 8, and the spacing between the suction cups 23 at their intermediate positions is set to S1 based on the detected width of the bag B. The table 3 that has been at rest starts to rotate at timing A of a rotation angle of 0 degree. While the main driving shaft 3 rotates through 120 degrees, for example, the table 3 rotates to move each pair of the grippers to the next station and stops at time C. The main driving shaft continues to rotate. Meanwhile, the servomotor 37 had started rotating at time B (earlier than time C) to have the suction cups 23 reach their respective closest positions at time D. It should be noted that the suction cups 23 start to move at time B before the movement of the bag B to the station III is completed. In this regard, time B and the speed of movement of the suction cups 23 are selected so that the suction cups 23 will not interfere with the movement of the bag B. During the period of time between times D and E, the suction cups 23 are stopped at their respective closest positions. The switching valve 49 is switched over at some point during a time period which starts immediately before time D that is when the suction cups 23 reach the closest positions and ends at E that is the termination of the period of time during which the suction cups 23 are stopped at the closest positions (See FIG. 4). As used herein, the term "immediately" is used to indicate a distance of not greater than 10 mm, more preferably of not greater than 5 mm. Thus, a vacuum is applied to the suction cups 23, causing the suction cups 23 to adhere to the outer surfaces of the opposite side walls of the bag B.

Figure 5:
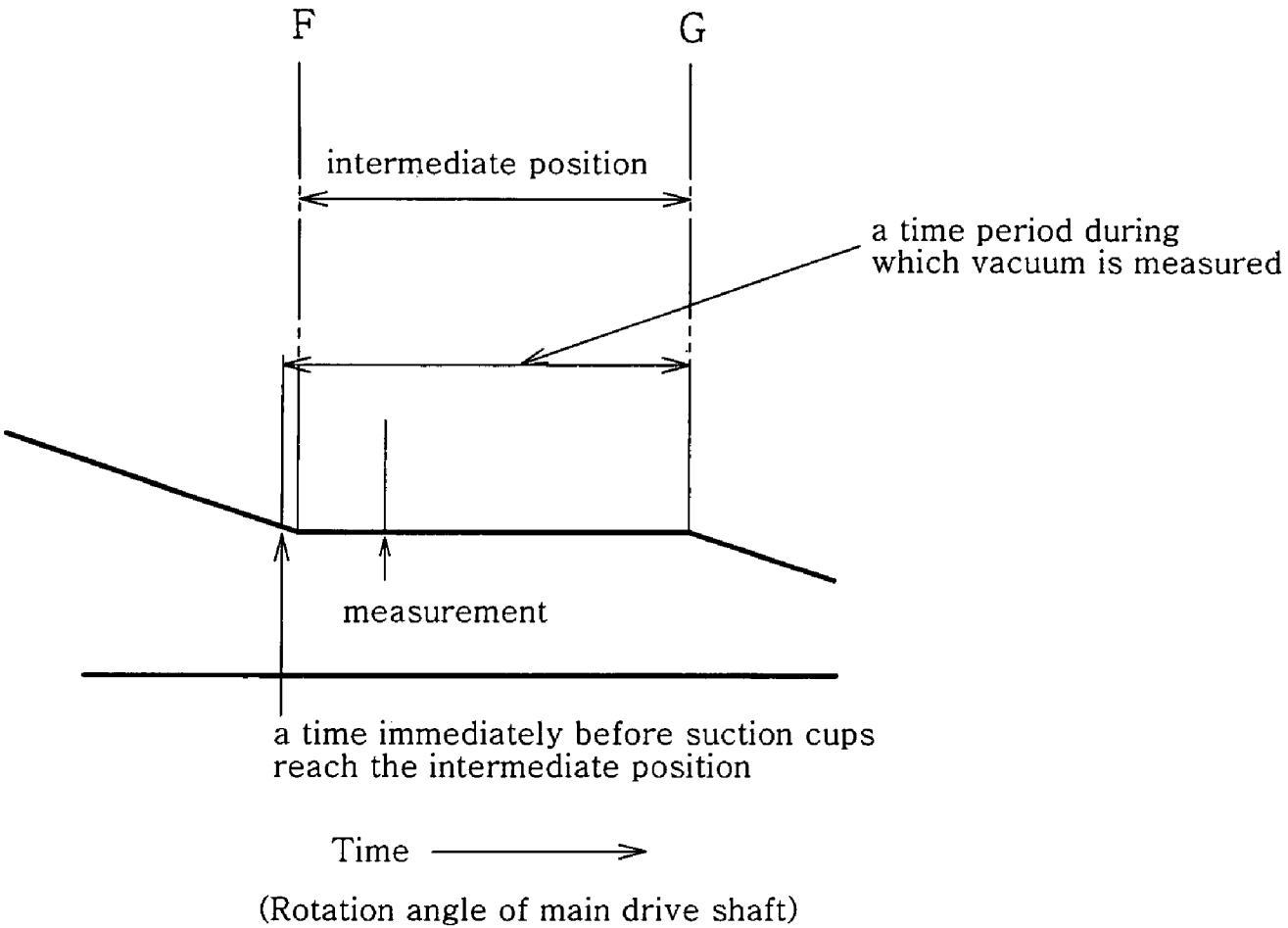
FIG. 5 is a time chart showing a time period during which measurement of vacuum is executed.

After the suction cups 23 have stopped at the closest positions for a predetermined period of time, the servomotor 37 starts to rotate in a direction opposite to the above at time E to retract the suction cups 23 away from each other. In synchronism with the movement of the suction cups 23, the grippers 5 gripping the laterally opposite side edges of the bag B move toward each other. The servomotor 37 temporarily stops rotating at time F at which the suction cups 23 reach their respective intermediate positions and thus the spacing therebetween becomes S1. The grippers 5 also stop at time F. The vacuum acting upon the suction cups 23 is detected with the pressure sensor 51 which is controlled by the controller 53 at some point during a time period which starts immediately before time F that is when the suction cups 23 reach their respective intermediate positions and ends at time G that is the termination of the period of time during which the suction cups 23 are stopped at the intermediate positions. (See FIG. 5). As used herein again, the term "immediately" is used to indicate a distance of not greater than 10 mm, more preferably of not greater than 5 mm. The detected vacuum data is sent to the controller 53 where it is compared to a preset reference value to judge whether or not the bag B has been opened satisfactorily.

Figure 6:
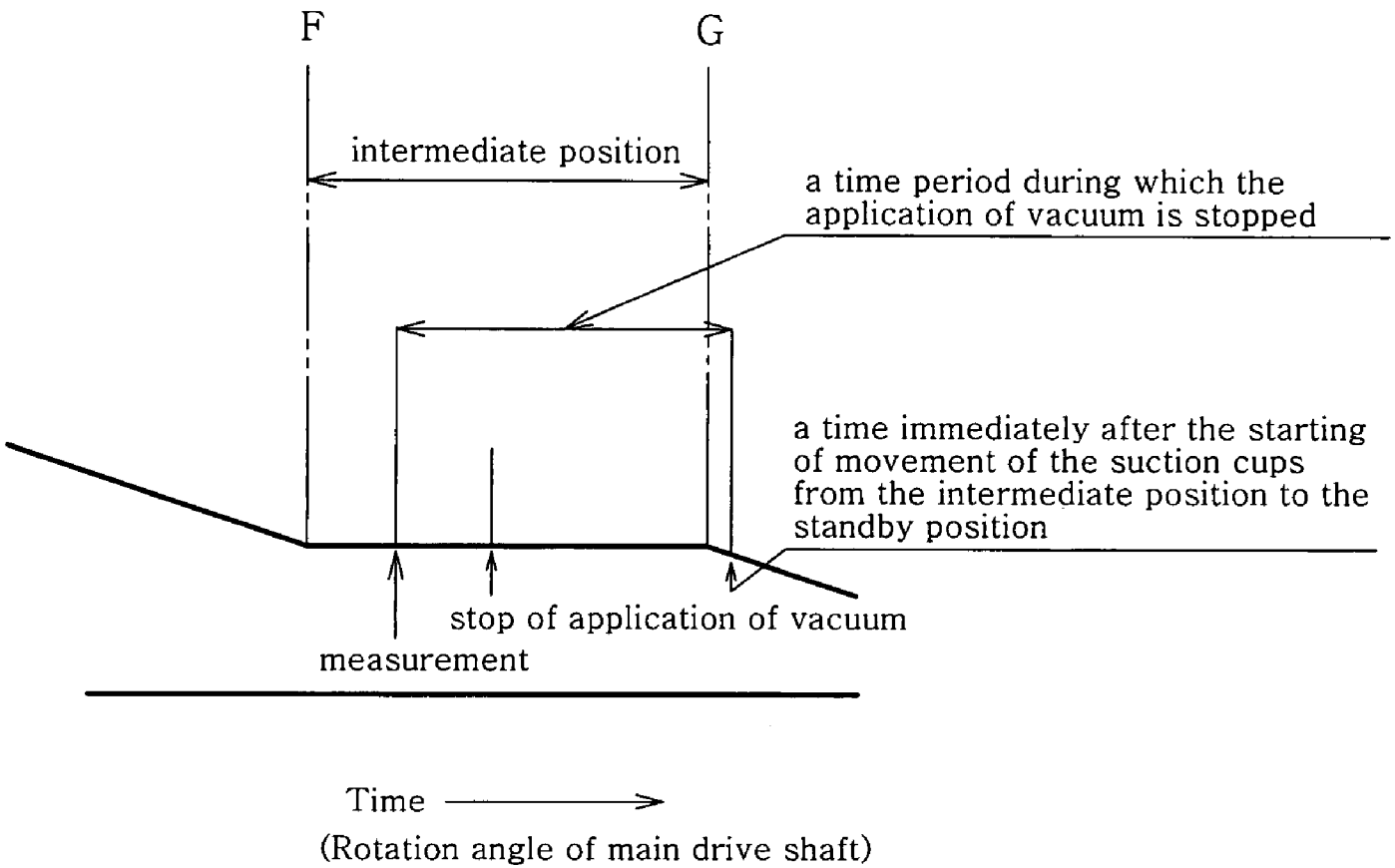
FIG. 6 is a time chart showing a time period during which the application of vacuum to the suction cups is stopped.
Figure 7:
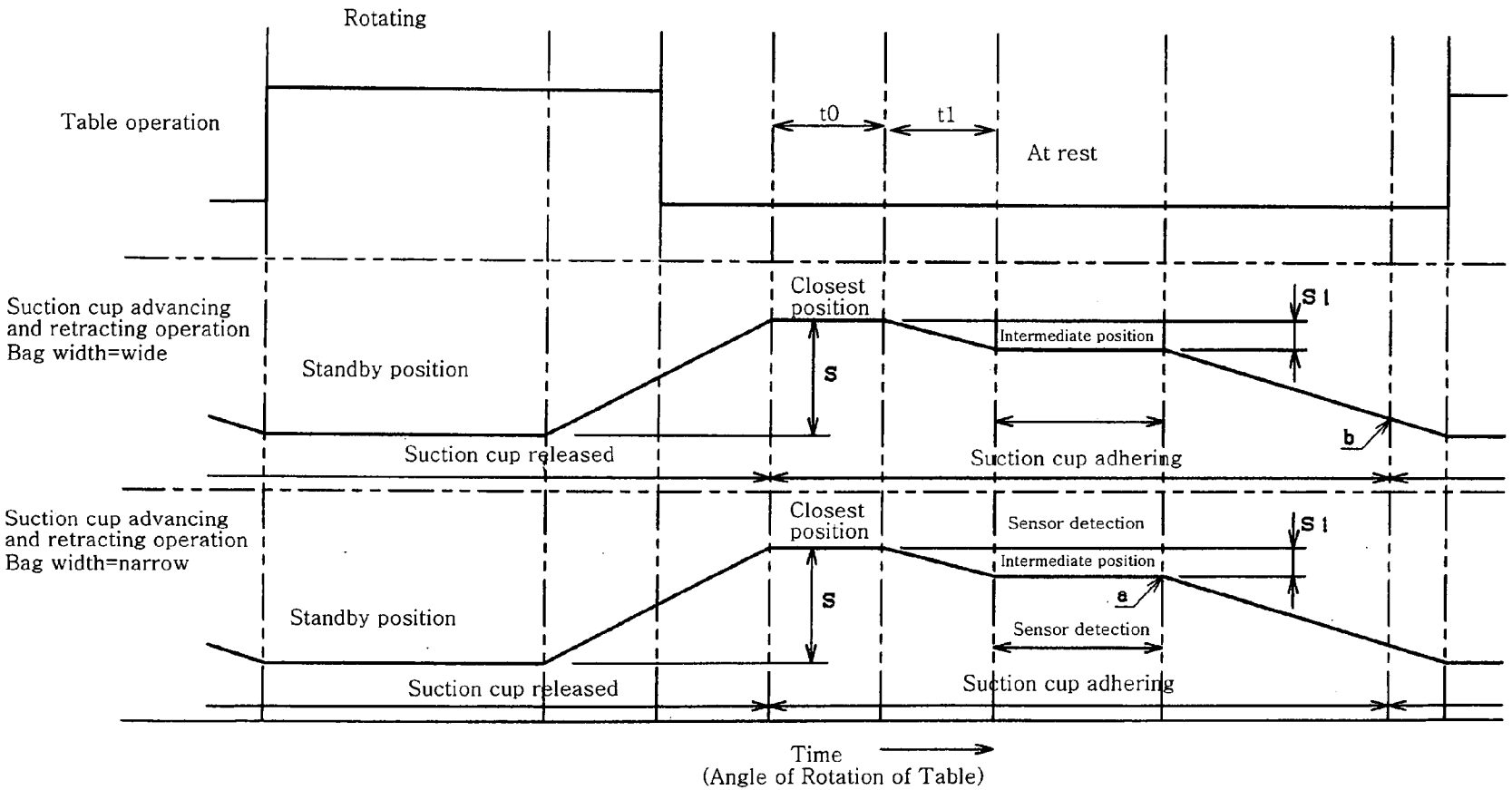
Fig.7 Prior Art
FIG. 7 is a time chart showing the operation of suction cups in a related art.
Figure 8:
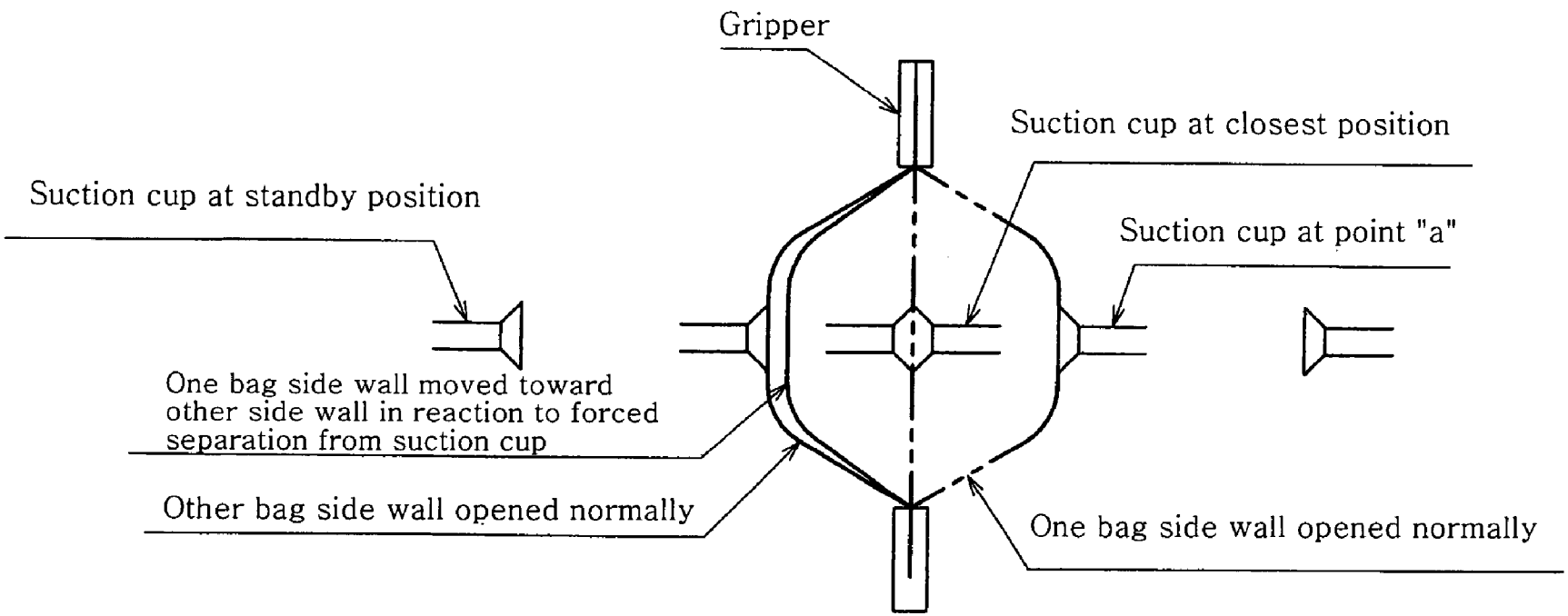
FIG. 8 is a diagram showing one example in which a bag is judged to have been opened satisfactorily despite the fact that it has failed to open satisfactorily in the related art.
Figure 9:
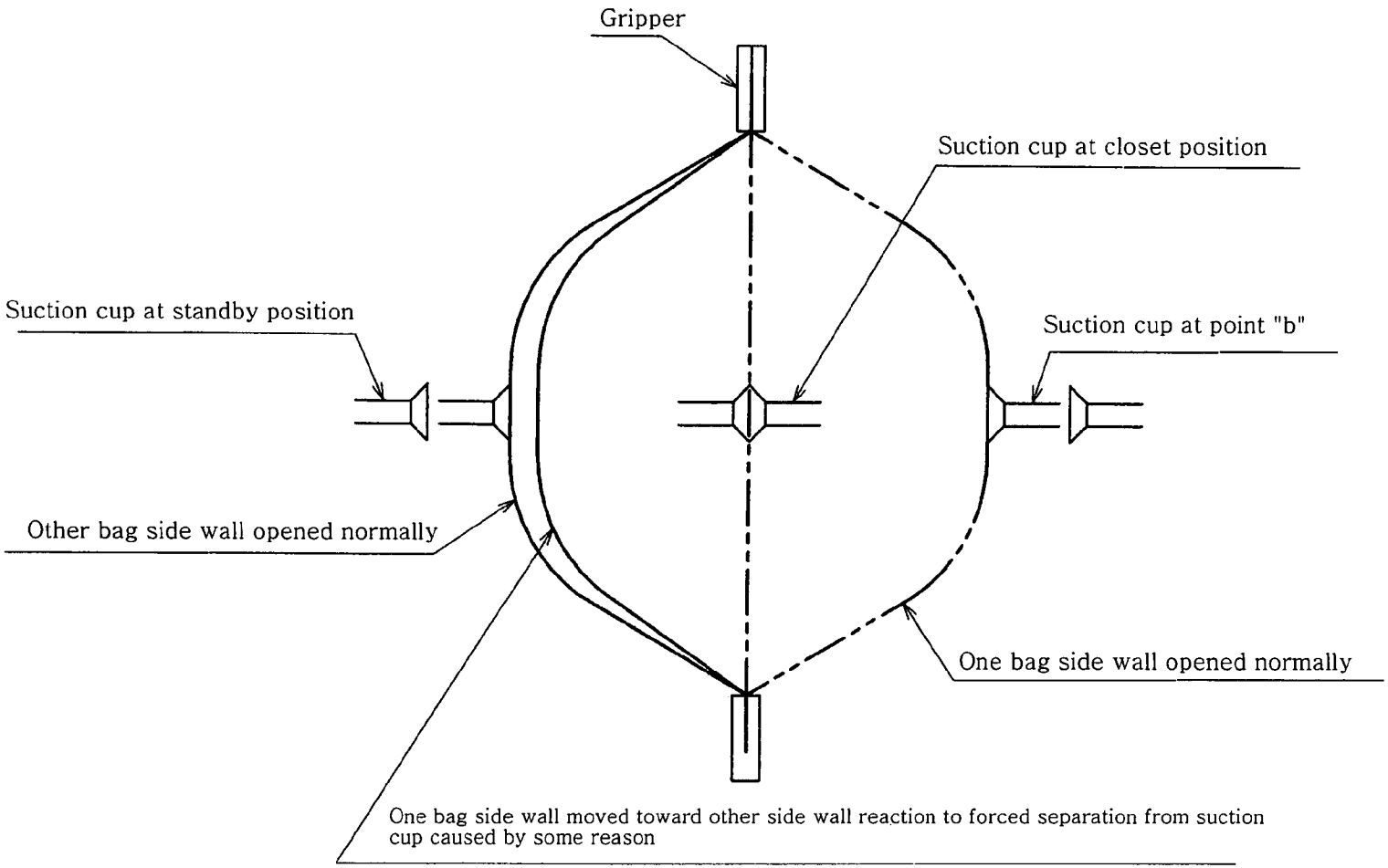
FIG. 9 is a diagram showing another example in which a bag is judged to have been opened satisfactorily despite the fact that it has failed to open satisfactorily in the related art.

The operation of opening the bag B may be arranged such that the degree of opening of the bag B reaches a maximum and the bag opening operation is completed when the suction cups 23 reach their respective intermediate positions. In this case, however, the bag mouth is tensed, so that the suction cups 23 are likely to separate from the bag B immediately before the vacuum is measured, depending on the timing of the vacuum measurement. For this reason, in this embodiment, the system is arranged such that when the suction cups 23 reach the intermediate positions, the bag opening operation has not yet been completely finished, but a slight allowance is left for the opening of the bag B. After the vacuum has been measured, the servomotor 37 is driven again at G to move the suction cups 23 toward their respective standby positions. In this process, after the suction cups 23 have moved slightly, namely, immediately after the suction cups started at time G to move from their respective intermediate positions to the standby positions, the mouth of the bag B is opened to a maximum, i.e. to a set desired degree of opening. As used herein again, the term "immediately" is used to indicate a distance of not greater than 10 mm, more preferably, of not greater than 5 mm. In synchronism with this, the switching valve 49 is switched over to stop the application of the vacuum to the suction cups 23. Meanwhile, the grippers 5 move toward each other again synchronously with the movement of the suction cups 23 and stop at the same time as the vacuum application stops. Consequently, the suction cups 23 separate from the bag B, and the bag B is maintained in the opened state. After separating from the bag B, the suction cups 23 move to return to their respective standby positions which are spaced from the intermediate positions by S2 and stop at time A. The bag B thus opened is moved to the station IV for the subsequent cycle. It should be noted that a bag judged to have failed to open satisfactorily passes through the stations IV to IX without undergoing operations and is discharged at the station X. The discharged bag is collected and recycled. It should be noted that the application of the vacuum to the suction cups 23 may be stopped at any time, for example, during the time when the suction cups 23 are at rest at their respective intermediate positions, provided that the vacuum application is stopped after the vacuum measurement. This alternative procedure will not hinder the operations carried out at the following steps because the process of opening the bag B has been substantially completed when the suction cups 23 reach their respective intermediate positions. FIG. 6 is a time chart showing a time period during which the application of vacuum to the suction cups may be stopped in this embodiment.

In the case of a bag B having a narrow width also, an operation similar to the above is carried out. That is, the width of the bag B is detected with the camera 8, and the detected data is sent to the controller 53 where an intermediate position spacing S3 is set based on the data. The suction cups 23 are moved and stopped in the same way as the above on the basis of the value of the spacing S3. Due to the difference between the spacings S1 and S3, the above-described times F and G are changed to times f and g, respectively. It should be noted that, in this embodiment, the following speeds and time periods for the suction cups 23 are set the same even for bags having different widths: the speed of movement from the standby position to the closest position; the dwell time at the closest position; the speed of movement from the closest position to the intermediate position; the dwell time at the intermediate position; and the speed of movement from the intermediate position to the standby position. Thus, regarding the times, only two times F (f) and G (g) change when the bag width changes, as has been stated above. However, the above-described movement speeds and dwell times can be changed according to need. In such a case, the other times also change correspondingly.

In the foregoing embodiment, the movement speeds and the dwell times are set the same, i.e. constant, regardless of the width of bags to be used. In this regard, the time chart for the control operation is based on the rotation angle of the driving shaft of the packaging machine 1, as has been stated above. Therefore, when the operating speed of the packaging machine 1 (bag opening apparatus 21) is changed, the time actually taken changes. However, even in such a case, the timing relative to the rotation angle does not change irrespective of the width of bags to be used.

In some modes of carrying out the present invention, the suction cups may be temporarily stopped during their movement from the closest positions to the intermediate positions, specifically at a relatively early time after the start of the movement. This is done for the following reason. The opposite side walls of a closed bag are difficult to separate from each other due to the influence of static electricity. Thus, the movement for opening the bag encounters a substantial resistance. Therefore, immediately after the start of the bag opening operation, the movement of the suction cups is temporarily stopped to stabilize the condition of the suction cups adhering to the bag. Thereafter, the bag opening operation is resumed. This is a conventional practice. That is, it should be noted that the stop position at which the suction cups are temporarily stopped during their movement from the closest positions to the intermediate positions is different from the "intermediate position" in the present invention.

What is claimed is:

1. A bag opening method for use in bag filling and packaging in which a bag is gripped at its laterally opposite side edges with a pair of gripping members and moved along a predetermined path to open said bag and to fill an article to be packaged into said bag, said method comprising the steps of:

moving a pair of suction cups which are facing each other from respective mutually spaced standby positions to respective closest positions at which said suction cups are closest to each other;

applying a vacuum to said pair of suction cups to adhere to outer surfaces of opposite side walls of said bag at said closest positions;

retracting said suction cups away from each other to respective intermediate positions between said closest positions and said standby positions while moving said gripping members toward each other in synchronism with movement of said suction cups to the intermediate positions;

keeping said suction cups stopped at said intermediate positions for a predetermined period of time;

measuring the vacuum being applied to said suction cups at some point during a time period which starts immediately before said suction cups reach said intermediate positions and ends at a termination of the period of time during which said suction cups are stopped at said intermediate positions;

retracting said suction cups from said intermediate positions to said standby positions, respectively;

stopping application of the vacuum to said suction cups at a time between a time after the measurement of vacuum and a time immediately after starting of movement of said suction cups to said standby positions;

comparing the vacuum measured to a preset reference value to judge whether or not said bag has been opened satisfactorily; and changing positions of said intermediate positions according to a width of the bag.

2. The bag opening method of claim 1, further comprising the step of:

detecting the width of said bag;

wherein the step of changing the positions of said intermediate positions is carried out on a basis of said width detected.

3. The bag opening method of claim 1, wherein a speed of movement of said suction cups from said closest positions to said intermediate positions, a dwell time of said suction cups at said intermediate positions, and a speed of movement of said suction cups from said intermediate positions to said standby positions are constant regardless of the positions of said intermediate positions.

4. The bag opening method of claim 2, wherein a speed of movement of said suction cups from said closest positions to said intermediate positions, a dwell time of said suction cups at said intermediate positions, and a speed of movement of said suction cups from said intermediate positions to said standby positions are constant regardless of the positions of said intermediate positions.

5. A bag opening apparatus for use in a bag filling and packaging machine in which a bag is gripped at its laterally opposite side edges with a pair of gripping members and moved along a predetermined path to open said bag and to fill an article to be packaged into said bag, said apparatus comprising:

a pair of suction cups disposed facing each other and connected to a vacuum source through a switching valve;

a servomotor that moves said suction cups between respective mutually spaced standby positions, respective closest positions at which said suction cups are closest to each other, and respective intermediate positions between said standby positions and closest positions;

a pressure sensor that detects a vacuum acting upon said suction cups; and a controller having a first control unit that controls application of a vacuum to said suction cups, a second control unit that controls said servomotor to control movement and stop of said suction cups, a third control unit that controls timing of vacuum detection by said pressure sensor, a judging unit that compares said vacuum detected to a preset reference value to judge whether or not said bag has been opened satisfactorily, and a fourth control unit that changes positions of said intermediate positions according to a width of a bag to be used.

6. The bag opening apparatus of claim 5, wherein said second control unit moves said suction cups from said standby positions to said closest positions, stops said suction cups at said closest positions for a predetermined period of time, moves said suction cups to said intermediate positions, stops said suction cups at said intermediate positions for a predetermined period of time, moves said suction cups to said standby positions, and stops said suction cups at said standby positions for a predetermined period of time;

said third control unit causing said pressure sensor to measure a vacuum acting upon said suction cups at some point during a time period which starts immediately before said suction cups reach said intermediate positions and ends at a termination of the period of time during which said suction cups stop at said intermediate positions;

said first control unit starting application of a vacuum to said suction cups at some point during a time period which starts immediately before said suction cups reach said closest positions and ends at a termination of the period of time during which said suction cups stop at said closest positions and releasing the vacuum at a time between a time after the measurement of vacuum and a time immediately after starting of movement of said suction cups to said standby positions.

7. The bag opening apparatus of claim 5, further comprising:

a bag width detecting unit that detects the width of said bag;

said fourth control unit changing the positions of said intermediate positions on a basis of a signal from said bag width detecting unit.

8. The bag opening apparatus of claim 6, further comprising:

a bag width detecting unit that detects the width of said bag;

said fourth control unit changing the positions of said intermediate positions on a basis of a signal from said bag width detecting unit.

9. The bag opening apparatus of any one of claims 5, wherein said second control unit maintains constant a speed of movement of said suction cups from said closest positions to said intermediate positions, a dwell time of said suction cups at said intermediate positions, and a speed of movement of said suction cups from said intermediate positions to said standby positions regardless of change of the positions of said intermediate positions made by said fourth control unit.

10. The bag opening apparatus of any one of claims 6, wherein said second control unit maintains constant a speed of movement of said suction cups from said closest positions to said intermediate positions, a dwell time of said suction cups at said intermediate positions, and a speed of movement of said suction cups from said intermediate positions to said standby positions regardless of change of the positions of said intermediate positions made by said fourth control unit.

11. The bag opening apparatus of any one of claims 7, wherein said second control unit maintains constant a speed of movement of said suction cups from said closest positions to said intermediate positions, a dwell time of said suction cups at said intermediate positions, and a speed of movement of said suction cups from said intermediate positions to said standby positions regardless of change of the positions of said intermediate positions made by said fourth control unit.

12. The bag opening apparatus of any one of claims 8, wherein said second control unit maintains constant a speed of movement of said suction cups from said closest positions to said intermediate positions, a dwell time of said suction cups at said intermediate positions, and a speed of movement of said suction cups from said intermediate positions to said standby positions regardless of change of the positions of said intermediate positions made by said fourth control unit.

* * * * *